US005775197A

United States Patent [19]

Kimura

[11] Patent Number: 5,775,197

[45] Date of Patent: Jul. 7, 1998

[54] PRESSURE REGULATING CIRCUIT

[75] Inventor: Noboru Kimura, Nagoya, Japan

[73] Assignee: Hirotaka Engineering Co., Ltd., Aici-Ken, Japan

[21] Appl. No.: 595,165

[22] Filed: Jan. 30, 1996

[51] Int. Cl.[6] ..... F15B 13/043

[52] U.S. Cl. ..... 91/433; 91/444

[58] Field of Search ..... 91/433, 444, 448

[56] References Cited

U.S. PATENT DOCUMENTS 5,065,665 11/1991 Kimura ..... 91/433

*Primary Examiner*—F. Daniel Lopez
*Attorney, Agent, or Firm*—Davis and Bujold

[57] ABSTRACT

Although a workpiece can be elevated or lowered according to the invention, the workpiece is prevented from rising or falling abruptly. When the workpiece is elevated with an external force, air supplied from the side of an auxiliary air supply chamber pushes down a pressure control piston. Since a difference in pressure between the side of a piston pressure chamber and the side of an auxiliary air supply chamber is small, air is prevented from flushing from the side of the auxiliary air supply chamber into the piston pressure chamber. When the workpiece is lowered with an external force, the pressure control piston is pushed up, thereby increasing the pressure in the piston pressure chamber. At the same time, a relief valve is opened and the piston pressure chamber is exhausted. By the provision of a relief valve, excess air is not exhausted from the piston pressure chamber. The pressure control piston is prevented from rising abruptly, and the workpiece can be gradually raised or lowered.

14 Claims, 8 Drawing Sheets

PRESSURE REGULATING CIRCUIT

FIELD OF THE INVENTION

This invention relates to a pressure regulating circuit in which the pressure of air to be supplied to the pressure chamber of a pneumatic cylinder is adjusted such that the force counteracting the load of a workpiece connected to a piston is applied to the piston.

BACKGROUND OF THE INVENTION

Conventionally, a pressure regulating circuit is known in which a workpiece attached to the tip of a piston rod can be elevated or lowered by a slight external force, just by adjusting the pressure inside an air cylinder chamber to counteract the force exerted against the workpiece.

As shown in FIG. 8, in a conventional pressure regulating circuit, a pressure chamber 8 of a main valve 6 is connected to a pressure chamber 4 of a pneumatic cylinder 2. The pressure chamber 8 is connected to and disconnected from, via an air supply valve member 12, an air supply chamber 10 which is connected to a pressure air supply R. An exhaust chamber 14, which is open to the outside air, is connected to and is disconnected from the pressure chamber 8 by means of an exhaust valve member 16.

A piston chamber 18 is provided above and independently of the exhaust chamber 14, and is divided into a control chamber 22 and a piston pressure chamber 24 by a pressure control piston 20. A piston rod 26 penetrating the pressure chamber 8 is connected to the piston 20. When the piston rod 26 lowers, the air supply valve member 12 is pressed down, thereby interconnecting the pressure chamber 8 and the air supply chamber 10. When the piston rod 26 is elevated, the exhaust valve member 16 is also elevated, thereby interconnecting the pressure chamber 8 and the exhaust chamber 14. The control chamber 22 is connected via an air pathway 28 to the pressure chamber 8. A port 30 of piston pressure chamber 24 communicates with an auxiliary pressure chamber 302 of a control valve 300, and is opened via an orifice 304 to the outside air.

In the control valve 300 an auxiliary air supply chamber 306 is connected to the auxiliary pressure chamber 302 at one side and to the pressure air supply R at the other side. The auxiliary pressure chamber 302 is connected to and disconnected from the auxiliary air supply chamber 306 by a valve member 308 having a shaft **308*a* penetrating through the auxiliary pressure chamber 302. A spring 310 is provided under the valve member 308 for urging valve member 308 to close. Upper end 308*b* of shaft 308*a* abuts the underside of a plate 318 mounted in the middle of a diaphragm 316, placed horizontally between the auxiliary control chamber 312 and a pressure spring chamber 314. The diaphragm 316 is urged downwardly by a pressure spring 320 provided in the pressure spring chamber 314, thereby lowering the valve member 308. The urging force of pressure spring 320 can be adjusted with a handle 322. The auxiliary control chamber 312 is connected via the air pathway 28 to the pressure chamber 8 and then to the control chamber 22, such that the pressure from pressure chamber 8 and control chamber 22 is introduced to the auxiliary control chamber 312**.

In the conventional pressure regulating circuit constructed as above, when the valve member 308 of control valve 300 is pushed down by the pressure spring 320, the pressure air flows from the supply R to the piston pressure chamber 24 of main valve 6, and the pressure control piston 20 lowers, thereby pushing downward the air supply valve member 12. The pressure air in turn flows from the supply R through the pressure chamber 8 to the cylinder pressure chamber 4, thereby allowing a piston P to rise together with a workpiece W. At this time the cylinder pressure chamber 4, the pressure chamber 8, the control chamber 22 and the auxiliary control chamber 312, which are interconnected to one another, have their pressure raised. When the pressure in control chamber 22 surpasses that in the piston pressure chamber 24, the pressure control piston 20 is pushed upwards, thereby lifting up the piston rod 26. The air supply valve member 12 is in turn raised, disconnecting the air supply chamber 10 from the pressure chamber 8, while the exhaust valve member 16 is elevated, interconnecting the pressure chamber 8 and the exhaust chamber 14. The pressure in the cylinder pressure chamber 4 is reduced, and the piston P is lowered. When, by supplying the pressure air to or discharging it from the pressure chamber 8, the pressure in control chamber 22 and the pressure in piston pressure chamber 24 reach equilibrium, the piston rod 26 is brought into a neutral position. As shown in FIG. 8, the air supply valve member 12 and the exhaust valve member 16 are in a closed position. No air is supplied to or discharged from the pressure chamber 8 or the cylinder pressure chamber 4. Therefore, the piston P and the workpiece W are in a balanced condition without being raised or lowered. As aforementioned, when the pressure in control chamber 22 and the pressure in piston pressure chamber 24 reach equilibrium, the piston P attains a balanced condition.

The balanced condition of piston P is brought about by balancing the pressure in control chamber 22 and piston pressure chamber 24. The pressure in piston pressure chamber 24 is regulated by the control valve 300. As shown in FIG. 8, when the urging force of pressure spring 320 surpasses the pressure in auxiliary control chamber 312 and the force of spring 310, thereby pushing down the valve member 308, the auxiliary air supply chamber 306 is connected with the auxiliary pressure chamber 302 and pressure air flows toward the auxiliary pressure chamber 302. Since the pressure air, having a larger airflow than the outflow amount from the orifice 304, flows toward the piston pressure chamber 24, the pressure in piston pressure chamber 24 is increased.

Contrarily, when the pressure in auxiliary control chamber 312 is increased to push the diaphragm 316 upwards, and the valve member 308 is elevated to disconnect the auxiliary air supply chamber 306 from the auxiliary pressure chamber 302, the pressure air stops flowing into the piston pressure chamber 24. Air then flows out of the orifice 304, and the pressure in piston pressure chamber 24 is reduced.

The pressure in piston pressure chamber 24 is regulated by the urging force of pressure spring 320 and by the pressure in auxiliary control chamber 312. The pressure in chamber 312 is equal to the pressure in control chamber 22, pressure chamber 8 and cylinder pressure chamber 4. When the urging force of pressure spring 320 is large, the pressure in auxiliary control chamber 312 retains high, while the pressure in piston pressure chamber 24 is in balance with that in auxiliary control chamber 312. Contrarily, when the urging force of pressure spring 320 is small, the pressure in auxiliary control chamber 312 remains low, while the pressure in piston pressure chamber 24 is in balance with that in auxiliary control chamber 312.

Specifically, in order to place the piston P in a balanced condition, if the workpiece W provides a large load, by increasing the urging force of pressure spring 320, the pressure in cylinder pressure chamber 4 is increased. If the workpiece W provides a small load, by reducing the urging force of pressure spring 320, the pressure in cylinder pressure chamber 4 is decreased.

Under such a balanced condition, by exerting an upward external force to the workpiece W, the workpiece W is elevated, thereby reducing the pressure in cylinder pressure chamber 4 and the control chamber 22. Accordingly, the pressure in auxiliary control chamber 312 is also reduced, thereby opening the control valve 300, and, as aforementioned, the pressure air, having a larger airflow than the outflow amount from the orifice 304, flows toward the piston pressure chamber 24, thereby increasing the pressure in piston pressure chamber 24. The pressure control piston 20 in turn lowers to push downwards the air supply valve member 12, and pressure air is supplied to the cylinder pressure chamber 4. Therefore, the workpiece W can be moved up with a slight external force.

Contrarily, under the aforementioned balanced condition, by exerting a downward external force on the workpiece W, the workpiece W is pushed downwards, thereby increasing the pressure in cylinder pressure chamber 4, control chamber 22 and auxiliary control chamber 312. The control valve 300 is then closed, and pressure air stops flowing toward the piston pressure chamber 24. Since air flows out of the orifice 304, the pressure in piston pressure chamber 24 is decreased. The pressure control piston 20 is in turn elevated to push the exhaust valve member 16 upwards, and pressure air is exhausted from the cylinder pressure chamber 4. The workpiece W can then be moved down with a slight external force.

When the workpiece W is raised or lowered with an external force and is stopped at a desired position, air is supplied to or exhausted from the pressure chamber 8. The pressure in control chamber 22 is thus in balance with that in piston pressure chamber 24. Thus, no air is supplied to or exhausted from the cylinder pressure chamber 4 and the workpiece W again attains a balanced condition.

As aforementioned, by adjusting the urging force of pressure spring 320 according to the load of workpiece W, the piston P can be brought into a balanced condition. By exerting a slight external force on the workpiece W in the balanced condition, the workpiece W can be elevated or lowered.

In the conventional pressure regulating circuit, instead of providing the pressure spring 320, pressure air can be supplied to the pressure spring chamber 314.

In the conventional pressure regulating circuit, however, if the workpiece is lightweight, and if the pressure in cylinder pressure chamber 4 under the balanced condition is low and has a large difference from the pressure in pressure air supply R, when the workpiece W is elevated with the external force, then the pressure in cylinder pressure chamber 4 is reduced. The pressure in auxiliary control chamber 312 and control chamber 22 is also reduced. The control valve 300 is opened, and high pressure air flows from the supply R into the piston pressure chamber 24, thereby pushing down the pressure control piston 20. The decrease in pressure in control chamber 22 increases the force pushing down on the pressure control piston 20. The air supply valve member 12 is pushed downwards in one stroke. High pressure air rushes from the supply R into the cylinder pressure chamber 4, thereby abruptly elevating the piston P and the workpiece W.

Contrarily, if the workpiece W is heavy, and if the pressure in cylinder pressure chamber 4 under the balanced condition is high, when the workpiece W is lowered with the external force, then the pressure in cylinder pressure chamber 4 is increased. The pressure in auxiliary control chamber 312 and control chamber 22 is also increased. The control valve 300 is closed. The air in piston pressure chamber 24, whose pressure is adjusted high according to the weight of the workpiece W, has a pressure largely different from the atmospheric pressure, and is flushed from the orifice 304. Irrespective of such a flush of air, no pressure air is supplied from the control valve 300 toward the piston pressure chamber 24. Therefore, the pressure in piston pressure chamber 24 is abruptly decreased, thereby pushing the pressure control piston 20 upwards. The elevated pressure in the control chamber 22 adds to the force raising control piston 20. The exhaust valve member 16 is pulled upwards in one stroke. Accordingly, air is flushed out of the pressure chamber 8, the pressure in cylinder pressure chamber 4 is abruptly reduced, and the piston P and the workpiece W are abruptly lowered.

Such an abrupt airflow resulting in the abrupt movement of mechanical components can be avoided, for example, by reducing a flow rate of pressure air to be supplied to or discharged from the piston pressure chamber 24. The decrease in flow rate, however, diminishes the responsiveness of main valve 6. The workpiece W is, therefore, prevented from going up and down smoothly.

SUMMARY OF THE INVENTION

Wherefore, an object of the present invention is to provide a pressure regulating circuit in which a workpiece can be securely and easily elevated or lowered, and to solve the aforementioned problem.

To attain this or other objects, the invention provides a pressure regulating circuit, in which by adjusting air pressure to be supplied to a pneumatic cylinder pressure chamber, the force counteracting the load of a workpiece attached to a piston is applied to the piston.

In the circuit, a main valve is provided with an air supply chamber connected to a pressure air source, and a pressure chamber is connected to or disconnected from the air supply chamber via an air supply valve member and connected to the cylinder pressure chamber. An exhaust chamber is connected to or disconnected from the pressure chamber via an exhaust valve member and connected to the outside air via an exhaust port, a piston rod and a pressure control piston. The piston rod places the air supply valve member and the exhaust valve member into a closed position when the piston rod is in a neutral position, opens the air supply valve member when the piston rod moves down, and opens the exhaust valve member when the piston rod moves up. The pressure control piston is displaced according to the difference in pressure between a control chamber connected to the pressure chamber and a piston pressure chamber opposed to the control chamber, thereby raising or lowering the piston rod.

The pressure regulating circuit is also provided with a control valve. The control valve is composed of an auxiliary air supply chamber for receiving pressure air from the pressure air source, an auxiliary pressure chamber connected to the piston pressure chamber and connected to the outside air via an orifice, and a valve member for connecting or disconnecting the auxiliary air supply chamber to or from the auxiliary pressure chamber according to a rise or fall in pressure in the control chamber. Air pressure from the pressure air source is reduced to a regulating pressure, predetermined according to the weight of the workpiece, before being supplied to the piston pressure chamber.

Further provided in the pressure regulating circuit is a pressure reducing valve interposed between the auxiliary air supply chamber of control valve and the pressure air source, for reducing air pressure from the pressure air source before supplying the reduced air pressure to the auxiliary air supply chamber.

The pressure regulating circuit is further provided with a relief valve at the side of the orifice open to the outside air, for maintaining the difference in pressure between the side of the orifice connected to the auxiliary pressure chamber and the side open to the outside air within a predetermined range.

Another respect of the invention provides a pressure regulating circuit provided with the aforementioned main valve and a control valve. The control valve is provided with an auxiliary pressure chamber connected to the piston pressure chamber and connected to the pressure air source via an orifice, an auxiliary exhaust chamber connected to the outside air, and a valve member for connecting or disconnecting the auxiliary pressure chamber to or from the auxiliary exhaust chamber according to a rise or a fall in pressure in the control chamber. Air pressure from the piston pressure chamber is kept, by the control valve, at a regulating pressure predetermined according to the weight of the workpiece.

In the pressure regulating circuit a pressure reducing valve is provided at the side of the orifice connected to the pressure air source for reducing air pressure from the pressure air source before supplying the reduced air pressure toward the orifice.

A relief valve is also provided in the pressure regulating circuit at the side of the auxiliary exhaust chamber of the control valve open to the outside air, and opens when the pressure in the auxiliary exhaust chamber equals or exceeds a predetermined value.

In the first aspect of the invention the air pressure from the pressure air source is reduced through the pressure reducing valve, before being supplied to the auxiliary air supply chamber. By adjusting the secondary pressure in the pressure reducing valve to a pressure slightly exceeding the regulating pressure, a difference in pressure is decreased between the piston pressure chamber in a balanced condition with regulating pressure and the auxiliary air supply chamber.

When the workpiece under the balanced condition is elevated with an external force, a decrease in pressure in the cylinder pressure chamber is followed by a decrease in pressure in the auxiliary control chamber and the control chamber. Even when the control valve is opened, the pressure control piston is prevented from falling down in one stroke. High pressure air is prevented from rapidly flowing from the pressure air source into the cylinder pressure chamber. Therefore, the pressure control piston and the workpiece are prevented from being abruptly elevated by means of a rapid flow of high pressure air into the cylinder pressure chamber.

The airflow into the piston pressure chamber, however, is not completely hampered, and the piston and the workpiece can be smoothly elevated.

The difference in pressure between the side of the orifice connected to the auxiliary pressure chamber and the side open to the outside air can be maintained within a predetermined range.

When the workpiece under the balanced condition is lowered with an external force, an increase in pressure in the cylinder pressure chamber is followed by an increase in pressure in the auxiliary control chamber and the control chamber. Even when the control valve is closed, air is prevented from being rapidly exhausted from the piston pressure chamber toward the orifice and the pressure control piston is prevented from being abruptly pushed upward. The exhaust valve member is also prevented from being abruptly pulled upward, and air is prevented from being rapidly exhausted from the pressure chamber. Furthermore, a rapid fall of pressure in the cylinder pressure chamber can be avoided. Therefore, the piston and the workpiece are prevented from being abruptly lowered.

The airflow exhausted from the piston pressure chamber is not completely hampered, and the piston as well as the workpiece can be smoothly lowered.

In the second aspect of the pressure regulating circuit, the pressure reducing valve reduces air pressure from the pressure air source to supply the reduced pressure toward the orifice. If the secondary pressure in the pressure reducing valve is adjusted to a pressure slightly higher than the regulating pressure, even when the workpiece placed under a balanced condition is elevated with an external force and a decrease in pressure in the cylinder pressure chamber results in a decrease in pressure in the control chamber, the pressure control piston is prevented from rapidly lowering. High pressure air supplied from the pressure air supply is prevented from rapidly flowing into the cylinder pressure chamber. Therefore, a rapid rising of the piston and workpiece can be avoided.

The airflow into the piston pressure chamber, however, is not completely hampered, and the piston as well as the workpiece can be smoothly elevated.

The relief valve is opened when the pressure in the auxiliary exhaust chamber equals or exceeds the predetermined value. Even when the workpiece under the balanced condition is lowered with an external force, an increase in pressure in the cylinder pressure chamber causes an increase in pressure in the auxiliary control chamber and the control valve is opened, air is prevented from being rapidly exhausted from the piston pressure chamber and the pressure control piston is prevented from being pushed upward rapidly. Therefore, the exhaust valve member is prevented from being abruptly pulled up, and air is prevented from being rapidly exhausted from the pressure chamber. A rapid fall in pressure in the cylinder pressure chamber can also be avoided. Therefore, a rapid falling of the piston and workpiece can be avoided.

The airflow exhausted from the piston pressure chamber, however, is not completely hampered, and the piston as well as the workpiece can be smoothly lowered.

BRIEF DESCRIPTION OF THE DRAWINGS

The invention will now be described, by way of example, with reference to the drawings, in which.

DETAILED DESCRIPTION OF THE PREFERRED EMBODIMENTS

Figure 1:
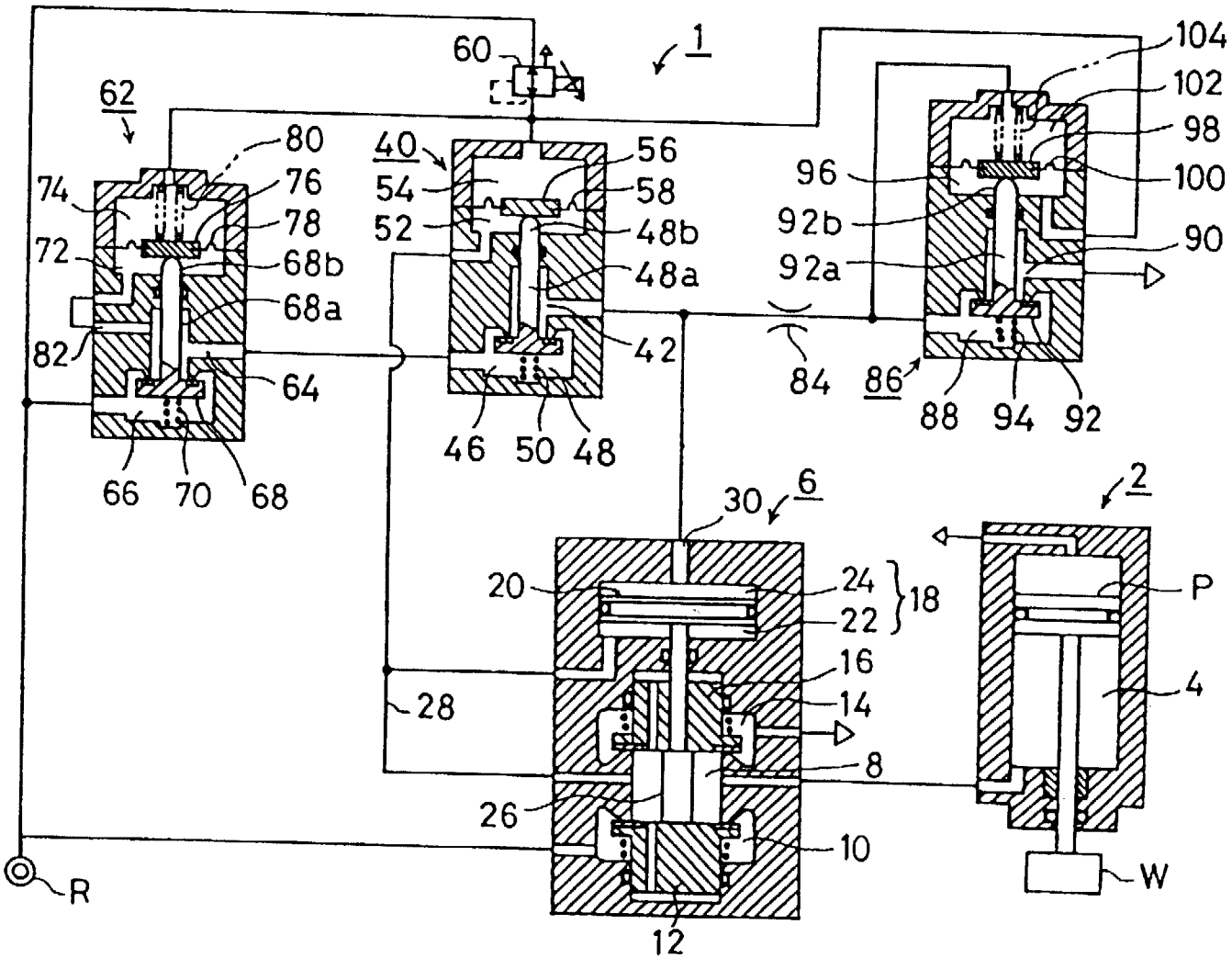
FIG. 1 is a diagrammatic representation of a pressure regulating circuit of the first embodiment of the invention.

Embodiments of the present invention will now be explained with reference to FIGS. 1–7. The reference numerals that are the same as those in FIG. 8 indicate the conventional components of the air cylinder and main valve in the conventional pressure regulating circuit. Therefore, a detailed explanation of the corresponding components is omitted hereinafter.

EMBODIMENT 1

As shown in FIG. 1, in the pressure regulating circuit 1 of the first embodiment, the port 30 connected to the piston pressure chamber 24 of main valve 6 communicates with an auxiliary pressure chamber 42 of a control valve 40. In the control valve 40, the auxiliary pressure chamber 42 is connected to or disconnected from an auxiliary air supply chamber 46 via a valve member 48 having a shaft 48*a* penetrating the auxiliary pressure chamber 42. A spring 50 for urging the valve member 48 to close is attached under the valve member 48. An upper end 48*b* of valve member 48 is projected into an auxiliary control chamber 52. A diaphragm 58, having a plate 56 in the middle thereof, is provided horizontally between the auxiliary control chamber 52 and an opposed diaphragm chamber 54, thereby separating these chambers from each other in an airtight manner. The upper end 48*b* of valve member 48 abuts the underside of plate 56.

The diaphragm chamber 54 is connected via an electropneumatic regulator 60 to the pressure air source R. When pressure air is introduced into the chamber 54, the valve member 48 is pushed downwards via the plate 56. The current value of electropneumatic regulator 60 can be manually adjusted, such that the pneumatic pressure to be introduced into the diaphragm chamber 54 can be adjusted. The force of diaphragm 58 pushing downwards on valve member 48 can thus be adjusted.

The auxiliary control chamber 52 is connected via the air pathway 28 to pressure chamber 8 and control chamber 22, such that the pressure in pressure chamber 8 and control chamber 22 is introduced into the auxiliary control chamber 52. The valve member 48 is positioned as a result of an upward urging force exerted by the spring 50 and a downward urging force exerted via the plate 56, according to the difference in pressure between the diaphragm chamber 54 and the auxiliary control chamber 52.

The auxiliary air supply chamber 46 of control valve 40 is connected to a pressure chamber 64 of a pressure reducing valve 62. The pressure reducing valve 62 is provided with an air supply chamber 66 connectable to the pressure chamber 64 at one side and to the pressure air source R at the other side.

The pressure chamber 64 is connected to and disconnected from the air supply chamber 66 via a valve member 68 having a shaft 68*a* penetrating the pressure chamber 64. A spring 70 for urging the valve member 68 to close is attached to the underside of the valve member 68. An upper end 68*b* of valve member 68 is projected into a control chamber 72. A diaphragm 78, having a plate 76 in the middle thereof, is provided horizontally between the control chamber 72 and an opposed diaphragm chamber 74 thereby separating these chambers from each other in an airtight manner. The upper end 68*b* of valve member 68 abuts the underside of the plate 76, such that the plate 76 is urged toward the valve member 68 by an upper spring 80 accommodated in the diaphragm chamber 74. The diaphragm chamber 74 is further connected to the secondary side of the electropneumatic regulator 60. When the pressure of the air introduced into the diaphragm chamber 74 is exerted on the diaphragm 78, the valve member 68 can be pushed downwards via the plate 76.

The control chamber 72 communicates via a port 82 to the pressure chamber 64, such that the pressure in pressure chamber 64 is introduced into the control chamber 72. The valve member 68 is positioned by the upward urging force of spring 70, the downward urging force of upper spring 80, and by the downward urging force exerted via the plate 76, according to the difference in pressure between the diaphragm chamber 74 and the control chamber 72. The pressure in control chamber 72 is always equal to that in pressure chamber 64 and auxiliary air supply chamber 46.

The upward urging force of spring 70 is, however, adjusted to slightly exceed the weight of the valve member 68. The valve member 68 is substantially positioned by the downward urging force of upper spring 80 and by a difference in pressure between the diaphragm chamber 74 and the control chamber 72. Therefore, the secondary pressure in pressure reducing valve 62, or pressure chamber 64, is higher, by the magnitude of the urging force of upper spring 80, than the secondary pressure introduced from the electropneumatic regulator 60 into the diaphragm chamber 74.

The auxiliary pressure chamber 42 of control valve 40 and the port 30 of main valve 6 are connected via an orifice 84 to a pressure chamber 88 in a relief valve 86. The relief valve 86 is constructed in almost the same manner as the pressure reducing valve 62: an exhaust chamber 90 is connected to or disconnected from the pressure chamber 88 by means of a valve member 92 having a shaft 92*a*; a spring 94 urges upwards the valve member 92 to close; a control chamber 96 accommodates an upper end 92*b* of valve member 92 projected inside; a diaphragm chamber 102 is partitioned from the control chamber 96 by a diaphragm 100 having a plate 98 in the middle thereof; and an upper spring 104 is provided in the diaphragm chamber 102 for urging the plate 98 down toward the valve member 92. The relief valve 86 is different from the pressure reducing valve 62 in that the equivalent of the port 82 is not provided. The control chamber 96 is connected to the secondary side of the electropneumatic regulator 60, and the diaphragm chamber 102 is connected to the downstream side of the orifice 84.

In the relief valve 86, the valve member 92 is positioned by the upward urging force of spring 94, the downward urging force of upper spring 104, and by the downward urging force exerted via the plate 98, according to the difference in pressure between the diaphragm chamber 102 and the control chamber 96. The pressure in diaphragm chamber 102 is equal to the pressure in auxiliary pressure chamber 42 of control valve 40 and to that in piston pressure chamber 24 of main valve 6. The pressure in control chamber 96 is equal to the secondary pressure in electropneumatic regulator 60.

The upward urging force of spring 94 is, however, adjusted to slightly exceed the weight of the valve member 92. The valve member 92 is substantially positioned by the downward urging force of upper spring 104 and by the difference in pressure between the diaphragm chamber 102 and the control chamber 96. Therefore, the pressure in pressure chamber 88 of relief valve 86 is lower by the magnitude of the urging force of upper spring 104, than the secondary pressure introduced from the electropneumatic regulator 60 into the control chamber 96.

In the operation of the pressure regulating circuit 1 constructed as aforementioned, the workpiece W is attached to the piston P before pressure air is introduced from the pressure air source R to the circuit 1.

The current value of electropneumatic regulator 60 is adjusted, for example, to a value such that the secondary pressure is minimized, and pressure air is introduced from the supply R to the circuit 1. The pressure in diaphragm chamber 54 of control valve 40 and the pressure in diaphragm chamber 74 of pressure reducing valve 62 are substantially gauged at zero(0), and the control valve 40 and the pressure reducing valve 62 are closed. By adjusting the current value of electropneumatic regulator 60 to gradually increase the secondary pressure, the pressure reducing valve 62 is opened and pressure air flows into the auxiliary air supply chamber 46 of control valve 40. When the pressure in chamber 46 and the pressure in control chamber 72 of pressure reducing valve 62 are increased, and the pressure exerted from the control chamber 72 onto the plate 76 exceeds the pressure from the diaphragm chamber 74, then the pressure reducing valve 62 is closed. In this manner the pressure in air supplied from the supply R is reduced by the pressure reducing valve 62 with the pressure introduced from the auxiliary air supply chamber 46 to the control chamber 72, the secondary pressure introduced from the electropneumatic regulator 60 to the diaphragm chamber 74 and the urging force of upper spring 80, before pressure air is flown to the auxiliary air supply chamber 46 of control valve 40.

When the secondary pressure in electropneumatic regulator 60 is increased, the control valve 40 is opened by the pressure in diaphragm chamber 54 and pressure air flows from the auxiliary air supply chamber 46 to the auxiliary pressure chamber 42. The pressure air flows into the piston pressure chamber 24 of main valve 6 to push the pressure control piston 20 downward. When the pressure control piston 20 lowers to push down the air supply valve member 12, pressure air is introduced from the supply R through the pressure chamber 8 into the cylinder pressure chamber 4, thereby urging the piston P to rise together with the workpiece W.

The pressure chamber 8, the control chamber 22 and the auxiliary control chamber 52, which communicate with the cylinder pressure chamber 4, have their inside pressure increasing. When the pressure in control chamber 22 exceeds that in piston pressure chamber 24, the pressure control piston 20 is pushed upwards and the pressure in piston pressure chamber 24 is raised according to the displacement of pressure control piston 20. The pressure in piston pressure chamber 24 is conducted from the orifice 84 to the pressure chamber 88 and the diaphragm chamber 102 in the relief valve 86. When the force exerted from diaphragm chamber 102 onto the plate 98 exceeds the force exerted from control chamber 96, the relief valve 86 is opened, thereby interconnecting the pressure chamber 88 and the exhaust chamber 90. The air in the pressure chamber 88 is exhausted from the exhaust chamber 90, resulting in a decrease in the pressure in piston pressure chamber 24. The pressure control piston 20 is raised to pull up the piston rod 26. While the piston rod 26 is rising, the air supply valve member 12 also rises to disconnect the air supply chamber 10 from the pressure chamber 8. The exhaust valve member 16 is also elevated, and the pressure chamber 8 and the exhaust chamber 14 are interconnected. The pressure in the cylinder pressure chamber 4 is reduced and the piston P is lowered.

When, by supplying and exhausting pressure air to and from the pressure chamber 8, the pressure in control chamber 22 is balanced with the pressure in piston pressure chamber 24, then the piston rod 26 attains a neutral position. In the neutral position, as shown in FIG. 1, the air supply valve member 12 and the exhaust valve member 16 are closed. No air is supplied to or exhausted from the pressure chamber 8 or the cylinder pressure chamber 4. The piston P and the workpiece W come to a balanced condition without rising or lowering. When the pressure in control chamber 22 and that in piston pressure chamber 24 are balanced, the piston P attains a balanced condition.

When the secondary pressure in electropneumatic regulator 60 is set high, the secondary pressure in control valve 40 and pressure reducing valve 62 is increased. Accordingly, the pressure in piston pressure chamber 24 is increased, and the pressure in cylinder pressure chamber 4 is also increased. Contrarily, when the secondary pressure in electropneumatic regulator 60 is set low, the pressure in cylinder pressure chamber 4 is decreased. By increasing or decreasing the secondary pressure in electropneumatic regulator 60, the pressure in cylinder pressure chamber 4 can be varied. By adjusting the secondary pressure in electropneumatic regulator 60 according to the weight of workpiece W, the aforementioned balanced condition can be attained.

After the electropneumatic regulator 60 is manually adjusted to attain the aforementioned balanced condition, the workpiece W is elevated with an external force. As the pressure in cylinder pressure chamber 4 is decreased, the pressure in auxiliary control chamber 52 and control chamber 22 is also decreased. The control valve 40 is thus opened, air flows from the auxiliary air supply chamber 46 into the piston pressure chamber 24, and the pressure control piston 20 is pushed downward. Since air pressure, which has been reduced via the pressure reducing valve 62, is supplied to the auxiliary air supply chamber 46, the difference in pressure between the piston pressure chamber 24 and the auxiliary air supply chamber 46 is reduced. Therefore, even when the control valve 40 is opened, air gradually flows from the auxiliary air supply chamber 46 into the piston pressure chamber 24. The pressure control piston 20 is also gradually lowered. Furthermore, high pressure air gradually flows from the pressure air source R into the cylinder pressure chamber 4. The piston P and the workpiece W are thus prevented from rising abruptly due to an abrupt flushing of high pressure air into the cylinder pressure chamber 4.

The airflow to the piston pressure chamber 24, however, is not completely hampered, and the piston P as well as the workpiece W can be elevated or lowered smoothly.

When the workpiece W, having been placed in the balanced condition, is lowered with an external force, the pressure in cylinder pressure chamber 4 is increased, the pressure in auxiliary control chamber 52 and control chamber 22 is also increased, and the control valve 40 is closed. At the same time, the pressure control piston 20 is pushed upwards. According to the displacement of the pressure control piston 20, the pressure in piston pressure chamber 24 is increased. When the pressure in piston pressure chamber 24 is increased, the relief valve 86 is opened and air is exhausted out of the piston pressure chamber 24. When the pressure in piston pressure chamber 24 lowers below the predetermined pressure required for opening the relief valve 86, the relief valve 86 is closed. Therefore, air is prevented from being exhausted excessively from the piston pressure chamber 24, the pressure control piston 20 is prevented from moving up abruptly, the piston rod 26 is also prevented from moving up abruptly, and further the exhaust valve member 16 is prevented from moving up abruptly. Air is prevented from rushing or flushing out of the pressure chamber 8.

Since a rapid fall in the pressure in cylinder pressure chamber 4 is thus avoided, the piston P and the workpiece W can be elevated or lowered gradually.

Since air is gradually exhausted from the piston pressure chamber 24, the piston P and the workpiece W are securely and smoothly lowered.

In the pressure regulating circuit 1 of the first embodiment, when an external force is exerted onto the workpiece W which has been placed in a balanced condition, the workpiece W can be securely and smoothly elevated or lowered. A rapid falling or rising of workpiece W can thus be avoided.

EMBODIMENT 2

Figure 2:
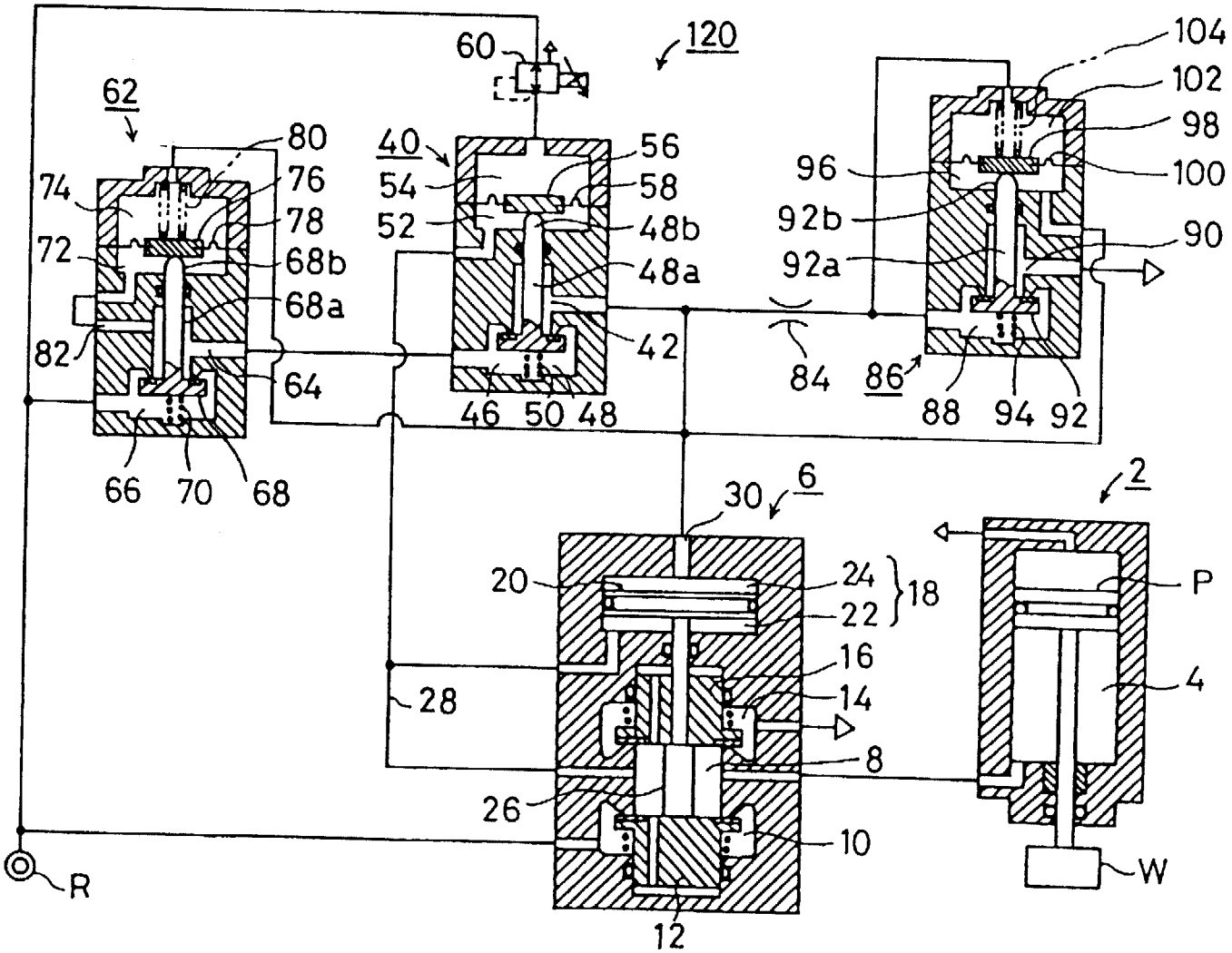
FIG. 2 is a diagrammatic representation of a pressure regulating circuit of the second embodiment of the invention.

As shown in FIG. 2, a pressure regulating circuit 120 of the second embodiment is composed of the main valve 6, the control valve 40, the pressure reducing valve 62, the relief valve 86 and other components described in the first embodiment. Therefore, a detailed explanation of the corresponding components is omitted hereinafter.

In the pressure regulating circuit 120 the diaphragm chamber 74 of pressure reducing valve 62 and the control chamber 96 of relief valve 86 are connected to the piston pressure chamber 24.

The action and effect of the pressure regulating circuit 120 are almost the same as those of the pressure regulating circuit 1 of the first embodiment.

EMBODIMENT 3

In the third embodiment, a control valve is provided at the exhaust side of a piston pressure chamber. The structural features and the performance of the third embodiment identical to that of the first and second embodiments is not explained hereinafter.

Figure 3:
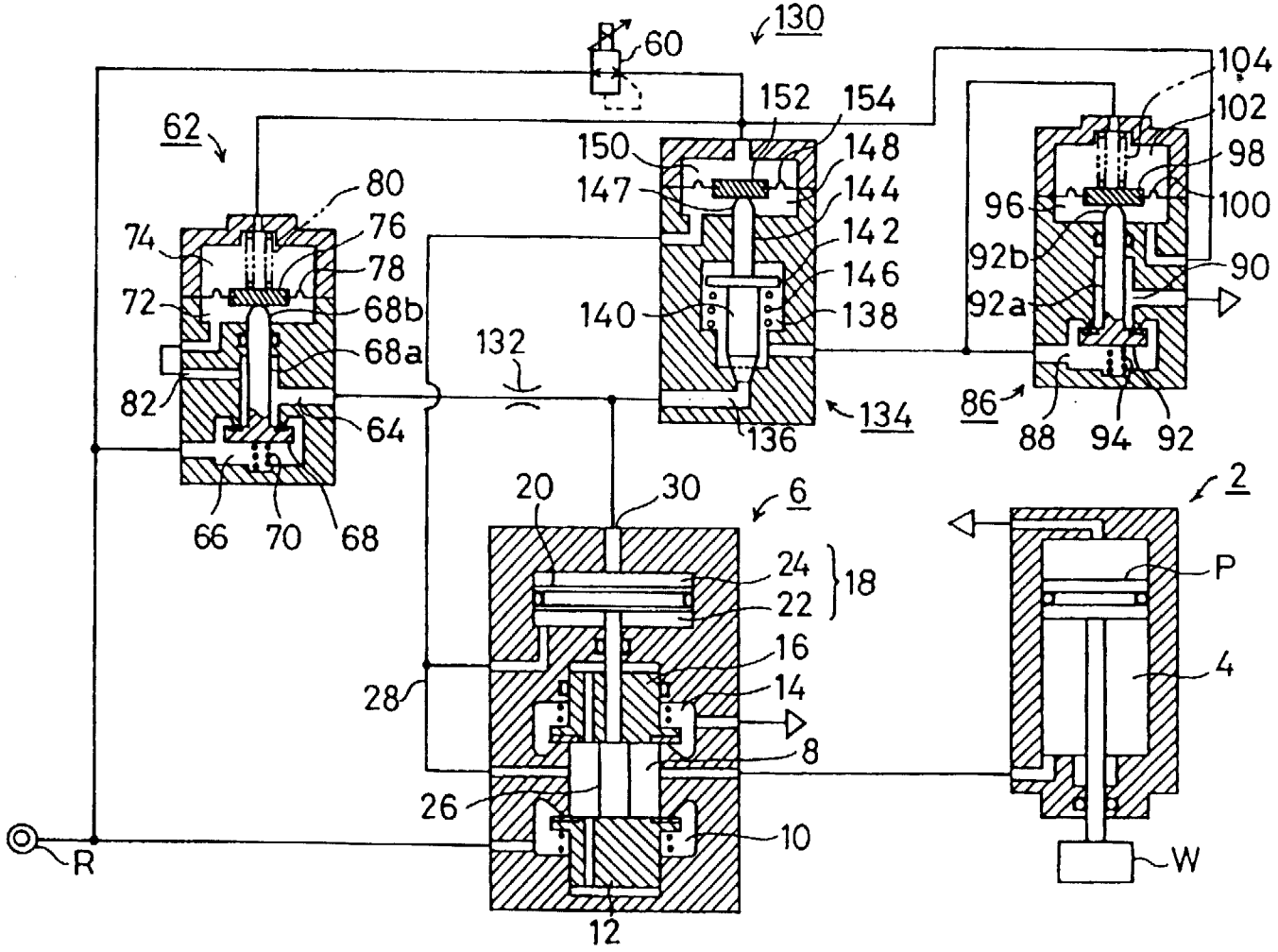
FIG. 3 is a diagrammatic representation of a pressure regulating circuit of the third embodiment of the invention.

As shown in FIG. 3, in a pressure regulating circuit 130, different from the first and second embodiments, the pressure chamber 64 of pressure reducing valve 62 is connected via an orifice 132 to the piston pressure chamber 24 of main valve 6. The pressure chamber 64 and the piston pressure chamber 24 are connected to an auxiliary pressure chamber 136 of a control valve 134.

In the control valve 134, an auxiliary exhaust chamber 138 is connected to or disconnected from the auxiliary pressure chamber 136 by means of a valve member 140 provided in the auxiliary exhaust chamber 138.

The valve member 140, to which a flange 142 and a shaft 144 are fixed, is urged to open via the flange 142 by a spring 146 accommodated in the auxiliary exhaust chamber 138.

An upper end 147 of the shaft 144 is projected into an auxiliary control chamber 148, which communicates with the pressure chamber 8 and the control chamber 22 in the main valve 6. A diaphragm 154, with a plate 152 placed in the middle thereof, is horizontally provided between the auxiliary control chamber 148 and an opposed diaphragm chamber 150, thereby sealing the chambers 148,150 in an airtight manner. The upper end 147 of shaft 144 directly abuts the underside of plate 152.

The diaphragm chamber 150 is connected to the secondary side of the electropneumatic regulator 60, and the auxiliary exhaust chamber 138 is connected to the pressure chamber 88 and the diaphragm chamber 102 in the relief valve 86.

The operation of the pressure regulating circuit 130, which differs from that of the circuits 1 and 120, will now be explained. Provided that the electropneumatic regulator 60 is adjusted according to the weight of the workpiece W, and the pneumatic cylinder 2 is placed in a balanced condition, the workpiece W is elevated with an external force. The pressure in cylinder pressure chamber 4 is decreased, and the pressure in auxiliary control chamber 148 and control chamber 22 is also reduced. A fall in the pressure in auxiliary control chamber 148 permits the control valve 134 to close. A fall in the pressure in control chamber 22 allows the pressure control piston 20 to move down. Since the piston rod 26 lowers, high pressure air flows from the pressure air source R into the cylinder pressure chamber 4.

When the pressure control piston 20 is lowered, the pressure in piston pressure chamber 24 drops. The pressure reducing valve 62 is then opened, supplying pressure air toward the orifice 132. The pressure air, which has been reduced via the pressure reducing valve 62, is introduced via the orifice 132 toward the piston pressure chamber 24. Therefore, the pressure in the piston pressure chamber 24, which is equal to that in the pressure chamber 64, is gradually increased. If the pressure in chamber 24 rises above the predetermined pressure, the pressure reducing valve 62 is closed. Air is thus prevented from being excessively supplied to the piston pressure chamber 24.

Since the pressure control piston 20 and the piston rod 26 are prevented from lowering rapidly, high pressure air from the pressure air source R is prevented from flushing into the cylinder pressure chamber 4. Furthermore, the piston P and the workpiece W are prevented from rapidly moving up.

However, airflow to the piston pressure chamber 24 is not hampered, and the piston P and the workpiece W can be elevated smoothly.

By pushing downward on the workpiece W, which has been placed in a balanced condition, with an external force, a rise in the pressure in cylinder pressure chamber 4 is accompanied by a rise in the pressure in auxiliary control chamber 148 and control chamber 22. The raised pressure in auxiliary control chamber 148 allows the control valve 134 to open. When the raised pressure in control chamber 22 pushes up the pressure control piston 20, the piston rod 26 also rises and air is exhausted from the cylinder pressure chamber 4 through the pressure chamber 8 and the exhaust chamber 14 to the outside air. At the same time, due to the rising of pressure control piston 20, the pressure in piston pressure chamber 24 is raised, thereby closing the pressure reducing valve 62.

When the control valve 134 is opened, air is introduced from the piston pressure chamber 24 to the auxiliary exhaust chamber 138 of control valve 134. When the pressure in auxiliary exhaust chamber 138 exceeds the pressure required for opening the relief valve 86, the relieve valve 86 is opened, thereby exhausting air from the piston pressure chamber 24. Contrarily, when the pressure in auxiliary exhaust chamber 138 lowers below the pressure required for opening the relief valve 86, the relief valve 86 is closed. Therefore, air is prevented from being rapidly exhausted from the piston pressure chamber 24, and the pressure control piston 20 and the piston rod 26 are prevented from abruptly rising. Furthermore, air is prevented from being rapidly exhausted from the pressure chamber 8. The piston P and the workpiece W are prevented from abruptly moving downward because of a rapid fall in the pressure in cylinder pressure chamber 4.

The airflow from the piston pressure chamber 24 is not completely hampered, and the piston P and the workpiece W move downward smoothly.

In the pressure regulating circuit 130 according to the third embodiment, the workpiece W is smoothly elevated or lowered when an external force is applied to the workpiece W which has been in a balanced condition. Furthermore, rapid movement of the workpiece W can be hampered.

EMBODIMENT 4

The structural features and the performance of the fourth embodiment which are similar or identical to that of third embodiment is not explained hereinafter.

Figure 4:
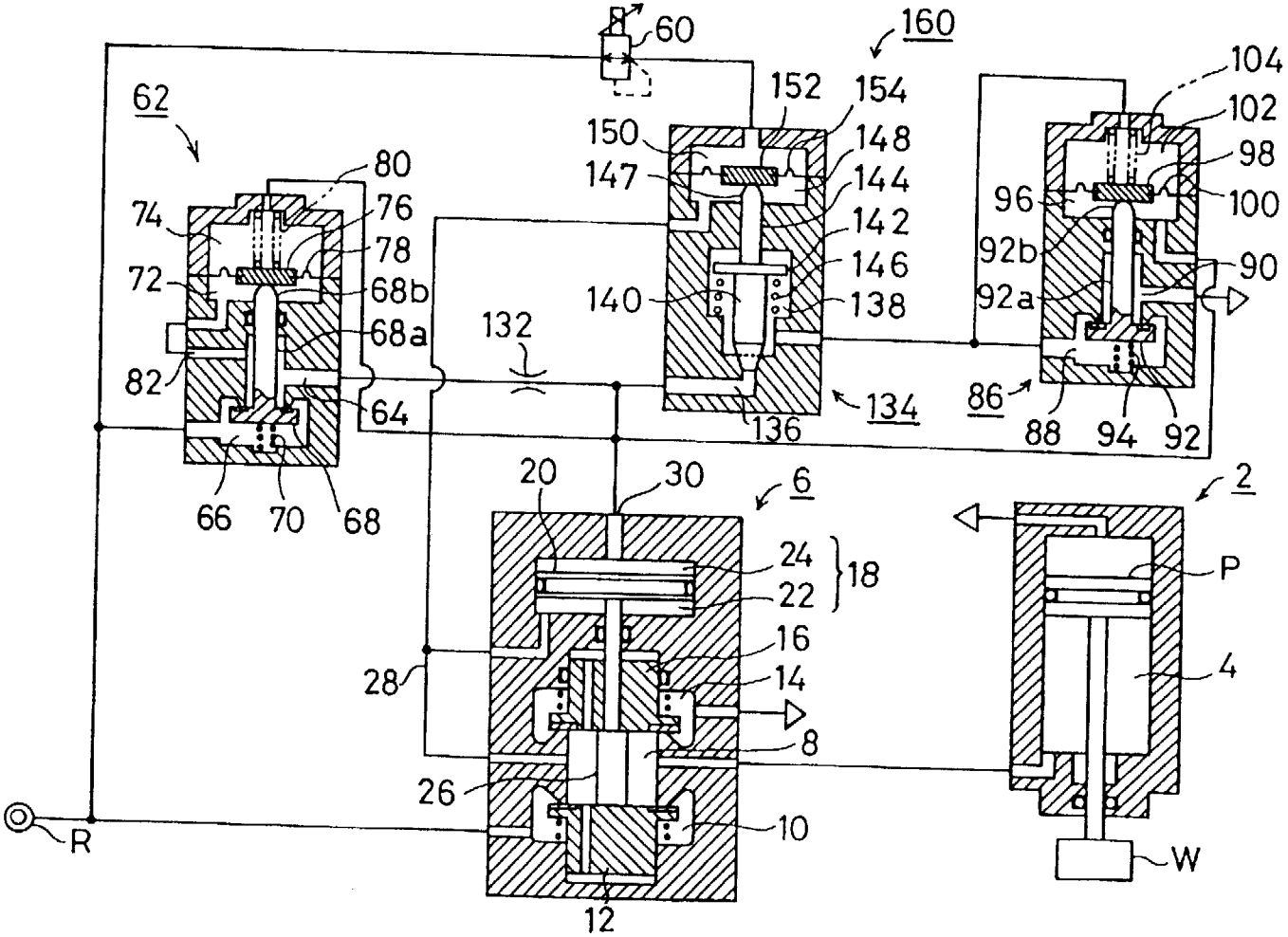
FIG. 4 is a diagrammatic representation of a pressure regulating circuit of the fourth embodiment of the invention.

As shown in FIG. 4, in a pressure regulating circuit 160 the diaphragm chamber 74 of pressure reducing valve 62 and the control chamber 96 of relief valve 86 are connected to the piston pressure chamber 24.

The pressure regulating circuit 160 is almost the same as the pressure regulating circuit 130 of the third embodiment with respect to operation and effectiveness.

MODIFICATION 1

Figure 5:
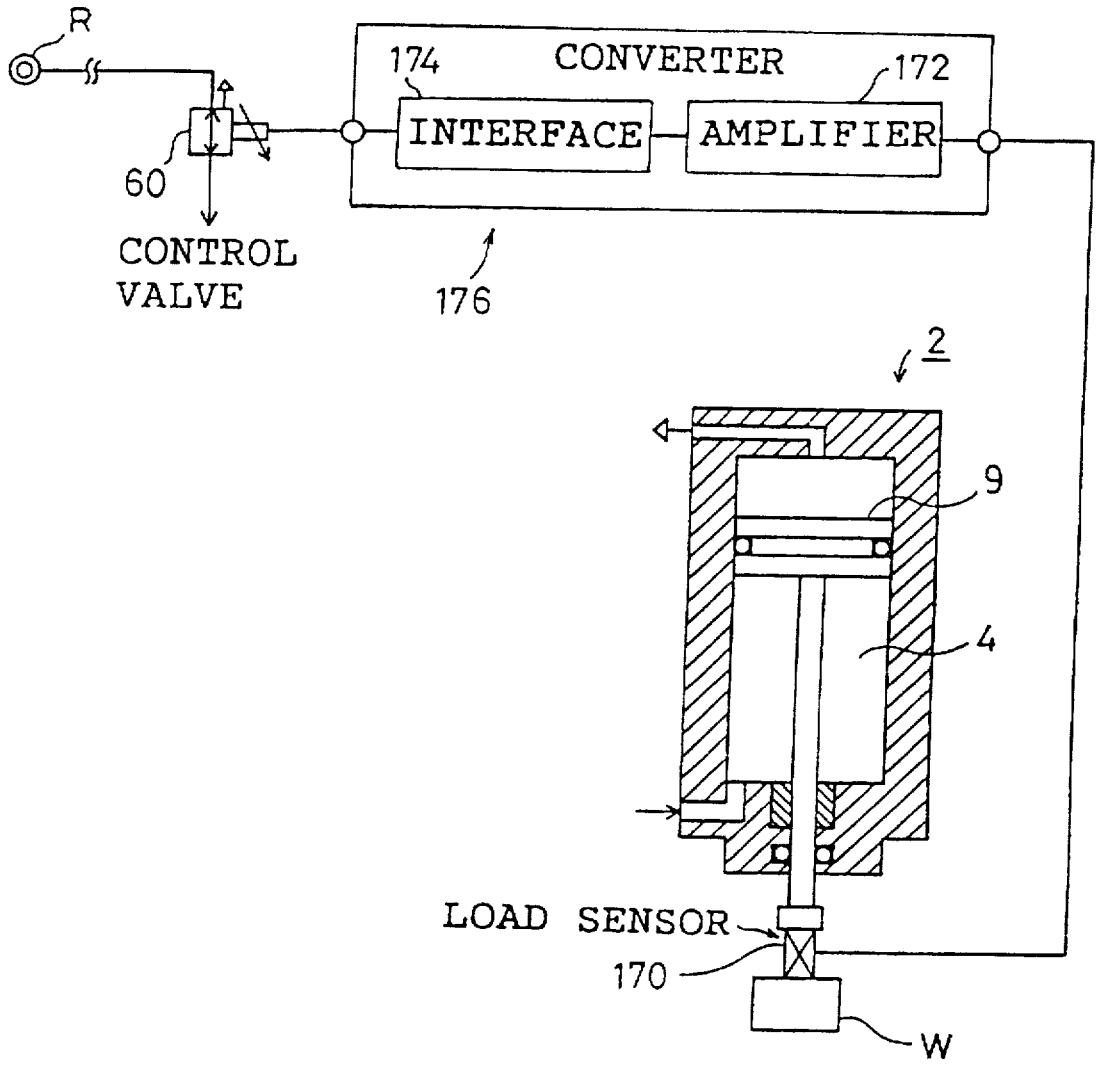
FIG. 5 is a diagrammatic representation of the main part of the first modification.
Figure 6:
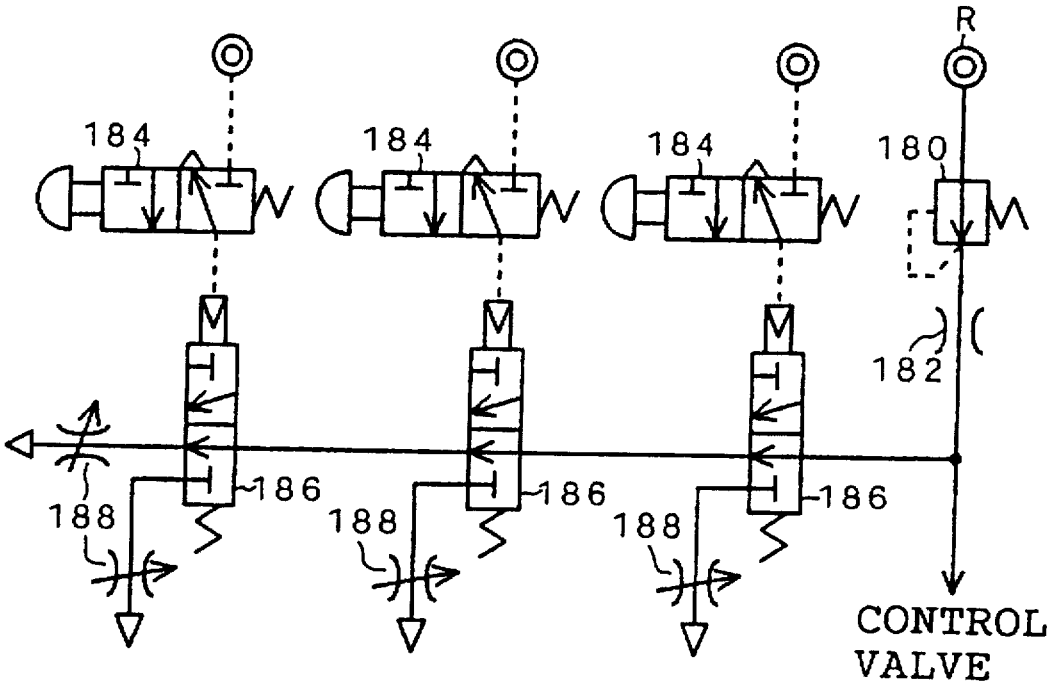
FIG. 6 is a diagrammatic representation of the main part of the second modification.

In the first to fourth embodiments the electropneumatic regulator 60 is manually adjusted according to the weight of workpiece W. As shown in FIG. 5, the electropneumatic regulator 60 can be adjusted based on an output from a load cell or sensor 170, which is interposed between the workpiece W and the piston rod attached to the workpiece W. Output of the load sensor 170 is converted by a converter 176 comprising an amplifier 172 and an interface 174, to a current value for use in control of the regulator 60. In such a modified structure, when the workpiece W is replaced by a new one, the necessity of adjusting the electropneumatic regulator 60 can be obviated. Work efficiency can thus be enhanced.

MODIFICATION 2

In the first to fourth embodiments the regulating pressure is set according to the weight of the workpiece W with the electropneumatic regulator 60. The regulator 60 can be replaced by a structure shown in FIG. 6. Specifically, a non-adjustable orifice 182 is provided at the secondary side of a pressure reducing valve 180 connected to the pressure air source R. A pneumatically operated valve 186 remotely operated by an air mechanical valve 184 and an adjustable orifice 188 are provided in a circuit branched from the downstream side of the non-adjustable orifice 182. The pressure supplied toward the control valve 40 or 134 is set according to a difference in exhaust airflow between the non-adjustable orifice 182 and the adjustable orifice 188.

The pneumatically operated valve 186 can be replaced by a solenoid valve, and the air mechanical valve 184 can be replaced by a limit switch or other operating element.

MODIFICATION 3

Figure 7:
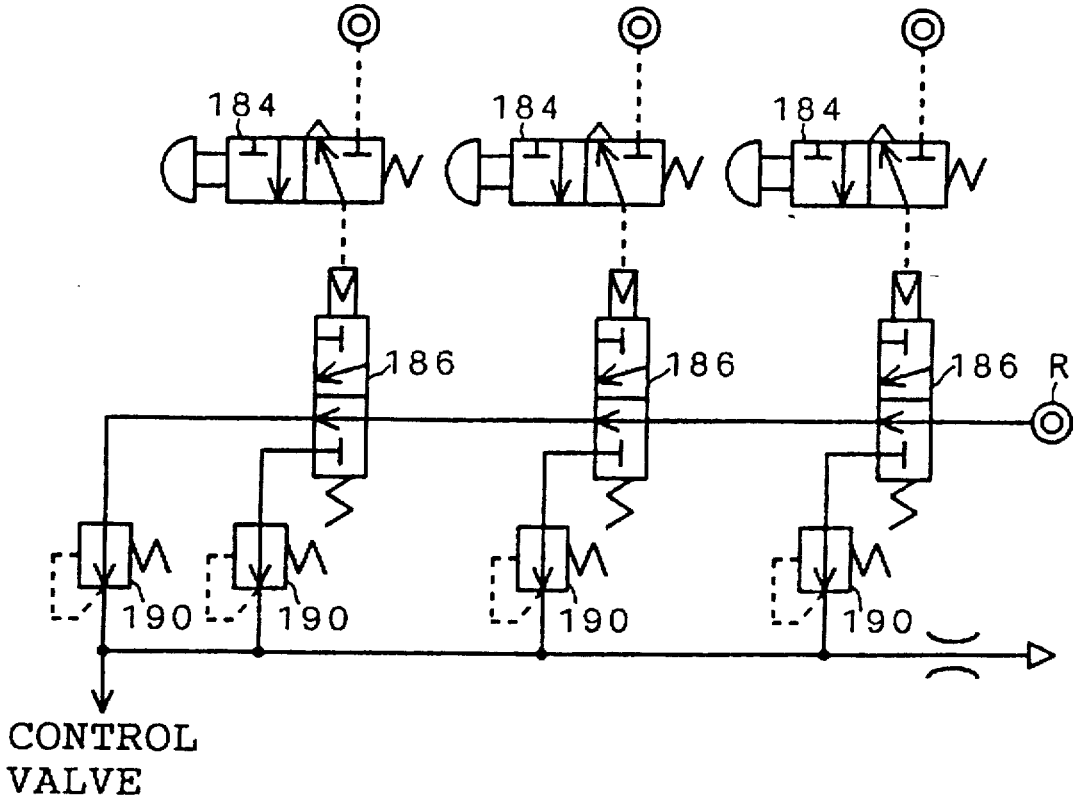
FIG. 7 is a diagrammatic representation of the main part of the third modification.
Figure 8:
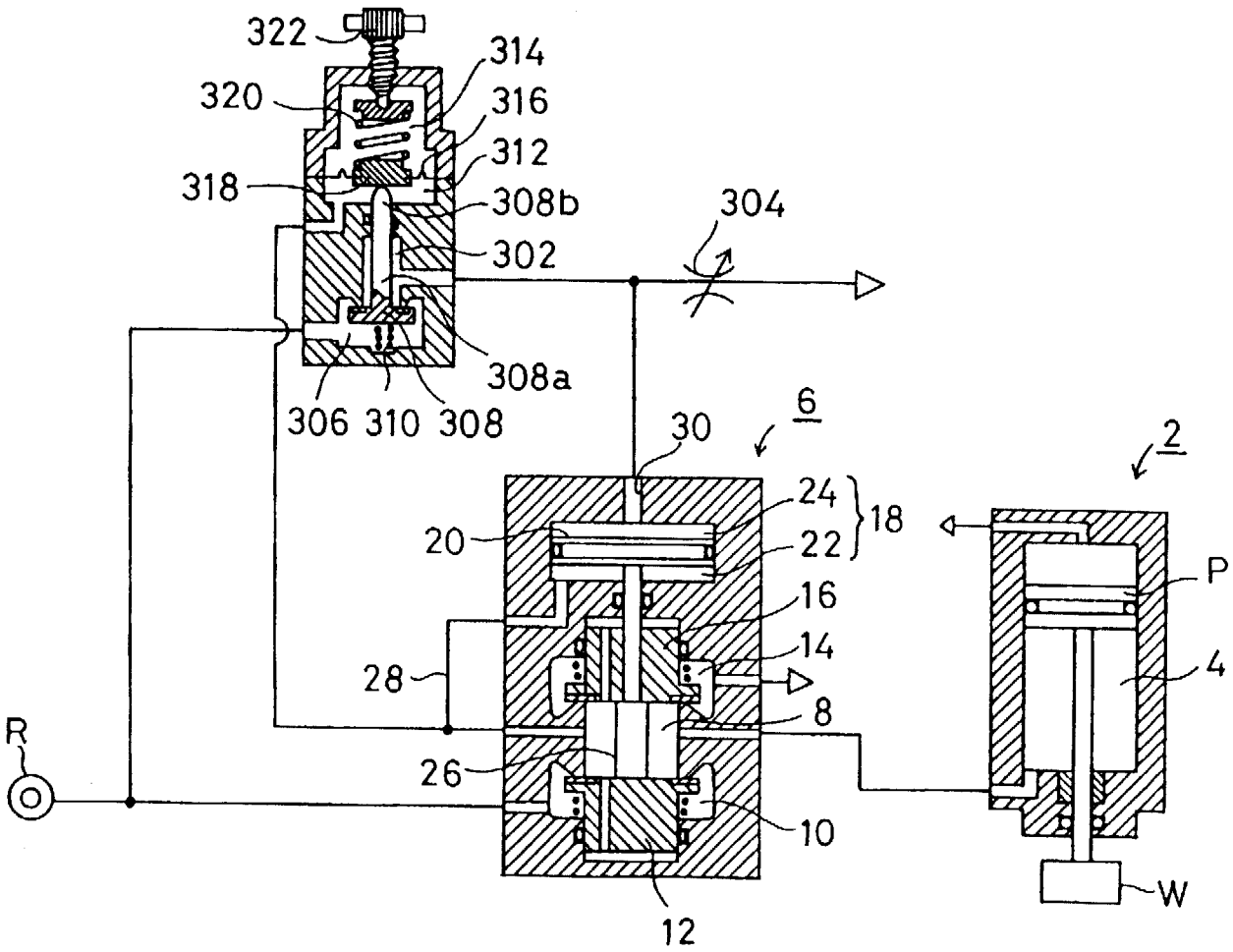
FIG. 8 PRIOR ART
FIG. 8 is a diagrammatic representation of the conventional pressure regulating circuit.

Like the aforementioned second modification, the electropneumatic regulator 60 can be replaced by a structure shown in FIG. 7. In the same way as in the second modification the pneumatically operated valve 186, remotely operated by the air mechanical valve 184, is provided in the circuit connected to the pressure air source R. A pressure reducing valve 190 is connected to the secondary side of the pneumatically operated valve 186, for setting the pressure to be supplied toward the control valve 40 or 134.

The pneumatically operated valve 186 can be replaced by a solenoid valve, or the air mechanical valve 184 can be replaced by a limit switch or other operating element.

This invention has been described above with reference to the preferred embodiments as shown in the figures. Modifications and alterations may become apparent to one skilled in the art upon reading and understanding the specification. Despite the use of the embodiment for illustration purposes, the invention is intended to include all such modifications and alterations within the spirit and scope of the appended claims.

For example, in the first embodiment, the diaphragm chamber 102 of relief valve 86 is connected to the downstream side of orifice 84. The diaphragm chamber 102 can be connected to the upstream side of orifice 84 or to piping connecting the control chamber 22 and the auxiliary control chamber 52.

In the third embodiment, the diaphragm chamber 102 of relief valve 86 is connected to the auxiliary exhaust chamber 138 of control valve 134. The diaphragm chamber 102 can be connected to the auxiliary pressure chamber 136 or to piping connecting the control chamber 22 and the auxiliary control chamber 148.

As a matter of course, the urging force of upper spring 104 is adjusted according to the pressure in the upstream side of orifice 84, the piping connecting the chambers 22, 52, the auxiliary pressure chamber 136 or the piping connecting the chambers 22, 148, to which the diaphragm chamber 102 is connected, and according to the pressure to be introduced toward the control chamber 96.

As aforementioned, in the pressure regulating circuit of the invention, the workpiece can be smoothly elevated or lowered. Furthermore, when an external force required for raising or lowering the workpiece is applied onto the workpiece which has been placed in a balanced condition, the workpiece can be prevented from abruptly rising or falling.

What is claimed is:

1. A pressure regulating circuit in which by adjusting air pressure to be supplied to a pneumatic cylinder pressure chamber (4), the force counteracting a load of a workpiece (W) attached to a work piston (P) is applied to said work piston (P), comprising:

a main valve (6) having:

a main air supply chamber (10) connected to a pressure air source (R), a main pressure chamber (8) connectable to said main air supply chamber (10) via an air supply valve member (12) and connected to said pneumatic cylinder pressure chamber (4), an main exhaust chamber (14) connectable to said main pressure chamber (8) via an exhaust valve member (16) and connected to the outside air via a main exhaust port, a piston rod (26) for maintaining said air supply valve member (12) and said exhaust valve member (16) in a closed position when said piston rod (26) is in a neutral position, for opening said air supply valve member (12) when said piston rod (26) moves in a first direction, and for opening said exhaust valve member (16) when said piston rod (26) moves in a second opposed direction, and a pressure control piston (20) for reciprocating and displacing according to a difference in pressure between a main control chamber (22) connected to said main pressure chamber (8) and a piston pressure chamber (24) opposed to said main control chamber (22), thereby raising and lowering said piston rod (26);

a control valve (40) having:

an auxiliary air supply chamber (46) for receiving pressure air from said pressure air source (R), an auxiliary pressure chamber (42) connected to said piston pressure chamber (24) and connected to outside air via a control orifice (84), a control valve member (48) for connecting and disconnecting said auxiliary air supply chamber (46) to and from said auxiliary pressure chamber (42) according to a rise and fall of pressure in said main control chamber (22), such that air pressure from said pressure air source (R) is reduced to a regulating pressure predetermined according to a weight of said workpiece (W) before being supplied to said piston pressure chamber (24), an auxiliary control chamber (52) being connected to said main control chamber (22) and said main pressure chamber (8) of said main valve (6), a control diaphragm chamber (54) being opposed to said auxiliary control chamber (52), a control valve diaphragm (58) for opening and closing said control valve member (48) based on a difference in pressure between said auxiliary control chamber (52) and said control diaphragm chamber (54), and a control spring (50) attached to said control valve member (48) for urging said control valve member (48) to a closed position;

a pressure reducing valve (62) being interposed between said auxiliary air supply chamber (46) of said control valve (40) and said pressure air source (R) for reducing air pressure from said pressure air source (R) before supplying the reduced air pressure to said auxiliary air supply chamber (46), said pressure reducing valve (62) having:

a pressure reducing air supply chamber (66) connected to said pressure air source (R), a pressure reducing pressure chamber (64) connectable to said pressure reducing air supply chamber (66) via a pressure reducing valve member (68) and connected to said auxiliary air supply chamber (46), a pressure reducing control chamber (72) connected to said pressure reducing pressure chamber (64), a pressure reducing diaphragm chamber (74) opposed to said pressure reducing control chamber (72) and connected to said piston pressure chamber (24), a pressure reducing diaphragm (78) for opening and closing said pressure reducing valve member (68) based on a difference in pressure between said pressure reducing control chamber (72) and said pressure reducing diaphragm chamber (74), a pressure reducing spring (70) attached to said pressure reducing valve member (68) for urging said pressure reducing valve member (68) to a closed position, and a pressure reducing diaphragm spring (80) attached to said pressure reducing diaphragm (78) for urging said pressure reducing diaphragm (78) toward said pressure reducing control chamber (72);

a relief valve (86), provided at the side of said control orifice (84) open to the outside air, for maintaining a difference in pressure between the side of said control orifice (84) connected to said auxiliary pressure chamber (42) and the side of said control orifice (84) open to the outside air within a predetermined range, said relief valve (86) having:

a relief pressure chamber (88) provided at the side of said control orifice (84) connected to the outside air, a relief exhaust chamber (90) connectable to said relief pressure chamber (88) via a relief valve member (92) and connected to the outside air via a relief exhaust port, a relief control chamber (96) connected to said piston pressure chamber (24), a relief diaphragm chamber (102) opposed to said relief control chamber (96) and connected to the side of said orifice (84) connected to said relief pressure chamber (88), a relief diaphragm (100) for opening and closing said relief valve member (92) based on a difference in pressure between said relief control chamber (96) and said relief diaphragm chamber (102), a relief spring (94) attached to said relief valve member (92) for urging said relief valve member (92) to a closed position, and a relief diaphragm spring (104) attached to said relief diaphragm (100) for urging said relief diaphragm (100) toward said relief control chamber (96); and a regulator (60) connected between said pressure air source (R) and said control diaphragm chamber (54).

2. A pressure regulating circuit according to claim 1 further comprising:

a sensor (170), for detecting the weight of said workpiece (W), having an output; and a converter (176) connected at a first end thereof to said sensor (170) and at a second end thereof to said regulator (60) for converting said output to a current value to control said regulator (60).

3. A pressure regulating circuit according to claim 1 wherein said regulator (60) comprises:

a pressure reducing regulator valve (180) connected between said pressure air source (R) and said control valve (40), and having an outlet;

a non-adjustable orifice (182) connected to said outlet of said pressure reducing regulator valve (180);

at least one circuit, branching from said non-adjustable orifice (182), comprising:

a valve (186), an air mechanical valve (184), remotely operating said valve (186), connected to said pressure air source (R), and an adjustable orifice (188), whereby the pressure of the air supplied to said control valve (40) is set according to a difference in exhaust airflow between said non-adjustable orifice (182) and said adjustable orifice (188).

4. A pressure regulating circuit according to claim 1 wherein said regulator (60) comprises:

at least one circuit comprising:

a valve (186) connected to said pressure air source (R), an air mechanical valve (184), remotely operating said valve (186), connected to said pressure air source (R), and a pressure reducing regulator valve (190) connected to a secondary side of said valve (186) for setting a pressure to be supplied to said control valve (40).

5. A pressure regulating circuit in which by adjusting air pressure to be supplied to a pneumatic cylinder pressure chamber (4), the force counteracting a load of a workpiece (W) attached to a work piston (P) is applied to said work piston (P), comprising:

a main valve (6) having:

a main air supply chamber (10) connected to a pressure air source (R), a main pressure chamber (8) connectable to said main air supply chamber (10) via an air supply valve member (12) and connected to said pneumatic cylinder pressure chamber (4), a main exhaust chamber (14) connectable to said main pressure chamber (8) via an exhaust valve member (16) and connected to the outside air via a main exhaust port, a piston rod (26) for maintaining said air supply valve member (12) and said exhaust valve member (16) in a closed position when said piston rod (26) is in a neutral position, for opening said air supply valve member (12) when said piston rod (26) moves in a first direction, and for opening said exhaust valve member (16) when said piston rod (26) moves in a second opposed direction, and a pressure control piston (20) for reciprocating and displacing according to a difference in pressure between a main control chamber (22) connected to said main pressure chamber (8) and a piston pressure chamber (24) opposed to said main control chamber (22), thereby raising and lowering said piston rod (26);

a control valve (40) having:

an auxiliary air supply chamber (46) for receiving pressure air from said pressure air source (R), an auxiliary pressure chamber (42) connected to said piston pressure chamber (24) and connected to the outside air via a control orifice (84), a control valve member (48) for connecting and disconnecting said auxiliary air supply chamber (46) to and from said auxiliary pressure chamber (42) according to a rise and fall of pressure in said main control chamber (22), such that air pressure from said pressure air source (R) is reduced to a regulating pressure predetermined according to a weight of said workpiece (W) before being supplied to said piston pressure chamber (24), an auxiliary control chamber (52) being connected to said main control chamber (22) and said main pressure chamber (8) of said main valve (6), a control diaphragm chamber (54) being opposed to said auxiliary control chamber (52), a control valve diaphragm (58) for opening and closing said control valve member (48) based on a difference in pressure between said auxiliary control chamber (52) and said control diaphragm chamber (54), and a control spring (50) being attached to said control valve member (48) for urging said control valve member (48) to a closed position;

a pressure reducing valve (62) being interposed between said auxiliary air supply chamber (46) of said control valve (40) and said pressure air source (R) for reducing air pressure from said pressure air source (R) before supplying the reduced air pressure to said auxiliary air supply chamber (46), said pressure reducing valve (62) having:

a pressure reducing air supply chamber (66) connected to said pressure air source (R), a pressure reducing pressure chamber (64) connectable to said pressure reducing air supply chamber (66) via a pressure reducing valve member (68) and connected to said auxiliary air supply chamber (46), a pressure reducing control chamber (72) connected to said pressure reducing pressure chamber (64), a pressure reducing diaphragm chamber (74) opposed to said pressure reducing control chamber (72), a pressure reducing diaphragm (78) for opening and closing said pressure reducing valve member (68) based on a difference in pressure between said pressure reducing control chamber (72) and said pressure reducing diaphragm chamber (74), a pressure reducing spring (70) attached to said pressure reducing valve member (68) for urging said pressure reducing valve member (68) to a closed position, and a pressure reducing diaphragm spring (80) attached to said pressure reducing diaphragm (78) for urging said pressure reducing diaphragm (78) toward said pressure reducing control chamber (72);

a relief valve (86), provided at the side of said control orifice (84) open to outside air, for maintaining a difference in pressure between the side of said control orifice (84) connected to said auxiliary pressure chamber (42) and the side of said control orifice (84) open to the outside air within a predetermined range, said relief valve (86) having:

a relief pressure chamber (88) provided at the side of said control orifice (84) connected to the outside air, a relief exhaust chamber (90) connectable to said relief pressure chamber (88) via a relief valve member (92) and connected to the outside air via a relief exhaust port, a relief control chamber (96), a relief diaphragm chamber (102) opposed to said relief control chamber (96) and connected to the side of said control orifice (84) connected to said relief pressure chamber (88), a relief diaphragm (100) for opening and closing said relief valve member (92) based on a difference in pressure between said relief control chamber (96) and said relief diaphragm chamber (102), a relief spring (94) attached to said relief valve member (92) for urging said relief valve member (92) to a closed position, and a relief diaphragm spring (104) attached to said relief diaphragm (100) for urging said relief diaphragm (100) toward said relief control chamber (96);

a regulator (60) being connected between said pressure air source (R) and said pressure reducing diaphragm chamber (74), said control diaphragm chamber (54), and said relief control chamber (96);

a sensor (170), for detecting the weight of said workpiece (W), having an output; and a converter (176) being connected at a first end thereof to said sensor (170) and at a second end thereof to said regulator (60) for converting said output to a current value to control said regulator (60).

6. A pressure regulating circuit according to claim 5 wherein said regulator (60) comprises:

a pressure reducing regulator valve (180) which is connected between said pressure air source (R) and said control valve (40), having an outlet;

a non-adjustable orifice (182) is connected to said outlet of said pressure reducing regulator valve (180);

at least one circuit, branching from said non-adjustable orifice (182), comprising:

a valve (186), an air mechanical valve (184), remotely operating said valve (186), connected to said pressure air source (R), and an adjustable orifice (188), whereby the pressure of the air supplied to said control valve (40) is set according to a difference in exhaust airflow between said non-adjustable orifice (182) and said adjustable orifice (188).

7. A pressure regulating circuit according to claim 5 wherein said regulator (60) comprises:

at least one circuit comprising:

a valve (186) connected to said pressure air source (R), an air mechanical valve (184), remotely operating said valve (186), connected to said pressure air source (R), and a pressure reducing regulator valve (190) connected to a secondary side of said valve (186) for setting a pressure to be supplied to said control valve (40).

8. A pressure regulating circuit in which by adjusting air pressure to be supplied to a pneumatic cylinder pressure chamber (4), the force counteracting a load of a workpiece (W) attached to a work piston (P) is applied to said work piston (P), comprising:

a main valve (6) having:

a main air supply chamber (10) connected to a pressure air source (R), a main pressure chamber (8) connectable to said main air supply chamber (10) via an air supply valve member (12) and connected to said pneumatic cylinder pressure chamber (4), a main exhaust chamber (14) connectable to said main pressure chamber (8) via an exhaust valve member (16) and connected to the outside air via a main exhaust port, a piston rod (26) for maintaining said air supply valve member (12) and said exhaust valve member (16) in a closed position when said piston rod (26) is in a neutral position, for opening said air supply valve member (12) when said piston rod (26) moves in a first direction, and for opening said exhaust valve member (16) when said piston rod (26) moves in a second opposed direction, and a pressure control piston (20) for reciprocating and displacing according to a difference in pressure between a main control chamber (22) connected to said main pressure chamber (8) and a piston pressure chamber (24) opposed to said main control chamber (22), thereby raising and lowering said piston rod (26);

a control valve (134) having:

an auxiliary pressure chamber (136) connected to said piston pressure chamber (24), and connected to said pressure air source (R) via a control orifice (132), an auxiliary exhaust chamber (138) connectable to said auxiliary pressure chamber (136) via a control valve member (140) and connected to outside air, said control valve member (140) for connecting and disconnecting said auxiliary pressure chamber (136) to and from said auxiliary exhaust chamber (138) according to a rise and fall of pressure in said main control chamber (22), such that air pressure from said piston pressure chamber (24) is kept at a regulating pressure predetermined according to a weight of said workpiece (W), an auxiliary control chamber (148) connected to said main control chamber (22) and said main pressure chamber (8) of said main valve (6), a control diaphragm chamber (150) opposed to said auxiliary control chamber (148), a control valve diaphragm (154) for opening and closing said control valve member (140) based on a difference in pressure between said auxiliary control chamber (148) and said control diaphragm chamber (150), and a control spring (146) attached to said control valve member (140) for urging said control valve member (140) to an opened position;

a pressure reducing valve (62) provided at the side of said control orifice 132) connected to said pressure air source (R), for reducing air pressure from said pressure air source (R) before supplying the reduced air pressure toward said control orifice (132), said pressure reducing valve (62) having:

a pressure reducing air supply chamber (66) connected to said pressure air source (R), a pressure reducing pressure chamber (64) provided at the side of said control orifice (132) connected to said pressure air source (R) and connectable to said pressure reducing air supply chamber (66) via a pressure reducing valve member (68), a pressure reducing control chamber (72) connected to said pressure reducing pressure chamber (64), a pressure reducing diaphragm chamber (74) opposed to said pressure reducing control chamber (72) and connected to said piston pressure chamber (24), a pressure reducing diaphragm (78) for opening and closing said pressure reducing valve member (68) based on a difference in pressure between said pressure reducing control chamber (72) and said pressure reducing diaphragm chamber (74), a pressure reducing spring (70) attached to said pressure reducing valve member (68) for urging said pressure reducing valve member (68) to a closed position, and a pressure reducing diaphragm spring (80) attached to said pressure reducing diaphragm (78) for urging said pressure reducing diaphragm (78) toward said pressure reducing control chamber (72);

a relief valve (86), provided at the side of said auxiliary exhaust chamber (138) of said control valve (134) open to the outside air, for opening when the pressure in said auxiliary exhaust chamber (138) equals a predetermined value, said relief valve (86) having:

a relief pressure chamber (88) connected to said auxiliary exhaust chamber (138), a relief exhaust chamber (90) connectable to said relief pressure chamber (88) via a relief valve member (92) and connected to the outside air via a relief exhaust port, a relief control chamber (96) connected to said piston pressure chamber (24), a relief diaphragm chamber (102) opposed to said relief control chamber (96) and connected to said auxiliary exhaust chamber (138), a relief diaphragm (100) for opening and closing said relief valve member (92) based on a difference in pressure between said relief control chamber (96) and said relief diaphragm chamber (102), a relief spring (94) attached to said relief valve member (92) for urging said relief valve member (92) to close, and a relief diaphragm spring (104) attached to said relief diaphragm (100) for urging said relief diaphragm (100) toward said relief control chamber (96); and a regulator (60) being connected between said pressure air source (R) and said control diaphragm chamber (150).

9. A pressure regulating circuit according to claim 8 further comprising:

a sensor (170), for detecting a weight of said workpiece (W), having an output; and a converter (176) connected at a first end thereof to said sensor (170) and at a second end thereof to said regulator (60) for converting said output to a current value to control said regulator (60).

10. A pressure regulating circuit according to claim 8 wherein said regulator (60) comprises:

a pressure reducing regulator valve (180) connected between said pressure air source (R) and said control valve (40), and having an outlet;

a non-adjustable orifice (182) connected to said outlet of said pressure reducing regulator valve (180);

at least one circuit, branching from said non-adjustable orifice (182), comprising:

a valve (186), an air mechanical valve (184), remotely operating said valve (186), connected to said pressure air source (R), and an adjustable orifice (188), whereby the pressure of the air supplied to said control valve (40) is set according to a difference in exhaust airflow between said non-adjustable orifice (182) and said adjustable orifice (188).

11. A pressure regulating circuit according to claim 8 wherein said regulator (60) comprises:

at least one circuit comprising:

a valve (186) connected to said pressure air source (R), an air mechanical valve (184), remotely operating said valve (186), connected to said pressure air source (R), and a pressure reducing regulator valve (190) connected to a secondary side of said valve (186) for setting a pressure to be supplied to said control valve (40).

12. A pressure regulating circuit in which by adjusting air pressure to be supplied to a pneumatic cylinder pressure chamber (4), the force counteracting a load of a workpiece (W) attached to a work piston (P) is applied to said work piston (P) comprising:

a main valve (6) having:

a main air supply chamber (10) connected to a pressure air source (R), a main pressure chamber (8) connectable to said main air supply chamber (10) via an air supply valve member (12) and connected to said pneumatic cylinder pressure chamber (4), a main exhaust chamber (14) connectable to said main pressure chamber (8) via an exhaust valve member (16) and connected to the outside air via a main exhaust port, a piston rod (26) for maintaining said air supply valve member (12) and said exhaust valve member (16) in a closed position when said piston rod (26) is in a neutral position, for opening said air supply valve member (12) when said piston rod (26) moves in a first direction, and for opening said exhaust valve member (16) when said piston rod (26) moves in a second opposed direction, and a pressure control piston (20) for reciprocating and displacing according to a difference in pressure between a main control chamber (22) connected to said main pressure chamber (8) and a piston pressure chamber (24) opposed to said main control chamber (22), thereby raising and lowering said piston rod (26);

a control valve (134) having:

an auxiliary pressure chamber (136) connected to said piston pressure chamber (24), and connected to said pressure air source (R) via a control orifice (132), an auxiliary exhaust chamber (138) connectable to said auxiliary pressure chamber (136) via a control valve member (140) and connected to outside air, said control valve member (140) for connecting and disconnecting said auxiliary pressure chamber (136) to and from said auxiliary exhaust chamber (138) according to a rise and fall of pressure in said main control chamber (22), such that air pressure from said piston pressure chamber (24) is kept at a regulating pressure predetermined according to a weight of said workpiece (W), an auxiliary control chamber (148) connected to said main control chamber (22) and said main pressure chamber (8) of said main valve (6), a control diaphragm chamber (150) opposed to said auxiliary control chamber (148), a control valve diaphragm (154) for opening and closing said control valve member (140) based on a difference in pressure between said auxiliary control chamber (148) and said control diaphragm chamber (150), and a control spring (146) attached to said control valve member (140) for urging said control valve member (140) to an opened position;

a pressure reducing valve (62) provided at the side of said control orifice (132) connected to said pressure air source (R), for reducing air pressure from said pressure air source (R) before supplying the reduced air pressure toward said control orifice (132), said pressure reducing valve (62) having:

a pressure reducing air supply chamber (66) connected to said pressure air source (R), a pressure reducing pressure chamber (64) provided at the side of said control orifice (132) connected to said pressure air source (R) and connectable to said pressure reducing air supply chamber (66) via a pressure reducing valve member (68), a pressure reducing control chamber (72) connected to said pressure reducing pressure chamber (64), a pressure reducing diaphragm chamber (74) opposed to said pressure reducing control chamber (72), a pressure reducing diaphragm (78) for opening and closing said pressure reducing valve member (68) based on a difference in pressure between said pressure reducing control chamber (72) and said pressure reducing diaphragm chamber (74), a pressure reducing spring (70) attached to said pressure reducing valve member (68) for urging said pressure reducing valve member (68) to a closed position, and a pressure reducing diaphragm spring (80) attached to said pressure reducing diaphragm (78) for urging said pressure reducing diaphragm (78) toward said pressure reducing control chamber (72);

a relief valve (86), provided at the side of said auxiliary exhaust chamber (138) of said control valve (134) open to the outside air, for opening when the pressure in said auxiliary exhaust chamber (138) equals a predetermined value, said relief valve (86) having:

a relief pressure chamber (88) connected to said auxiliary exhaust chamber (138), a relief exhaust chamber (90) connectable to said relief pressure chamber (88) via a relief valve member (92) and connected to the outside air via a relief exhaust port, a relief control chamber (96), a relief diaphragm chamber (102) opposed to said relief control chamber (96) and connected to said auxiliary exhaust chamber (138), a relief diaphragm (100) for opening and closing said relief valve member (92) based on a difference in pressure between said relief control chamber (96) and said relief diaphragm chamber (102).

a relief spring (94) attached to said relief valve member (92) for urging said relief valve member (92) to a closed position, and a relief diaphragm spring (104) attached to said relief diaphragm (100) for urging said relief diaphragm (100) toward said relief control chamber (96);

a regulator (60) being connected between said pressure air source (R) and said pressure reducing diaphragm chamber (74), said control diaphragm chamber (150), and said relief control chamber (96);

a sensor (170), for detecting the weight of said workpiece (W), having an output; and a converter (176) being connected at a first end thereof to said sensor (170) and at a second end thereof to said regulator (60) for converting said output to a current value to control said regulator (60).

13. A pressure regulating circuit according to claim 12 wherein said regulator (60) comprises:

a pressure reducing regulator valve (180) connected between said pressure air source (R) and said control valve (40), and having an outlet;

a non-adjustable orifice (182) connected to said outlet of said pressure reducing regulator valve (180);

at least one circuit, branching from said non-adjustable orifice (182), comprising:

a valve (186), an air mechanical valve (184), remotely operating said valve (186), connected to said pressure air source (R), and an adjustable orifice (188), whereby the pressure of the air supplied to said control valve (40) is set according to a difference in exhaust airflow between said non-adjustable orifice (182) and said adjustable orifice (188).

14. A pressure regulating circuit according to claim 12 wherein said regulator (60) comprises:

at least one circuit comprising:

a valve (186) connected to said pressure air source (R), an air mechanical valve (184), remotely operating said valve (186), connected to said pressure air source (R), and a pressure reducing regulator valve (190) connected to a secondary side of said valve (186) for setting a pressure to be supplied to said control valve (40).

* * * * *